US007753754B2

(12) United States Patent
Curtis et al.

(10) Patent No.: US 7,753,754 B2
(45) Date of Patent: Jul. 13, 2010

(54) SUBMERSIBLE DEVICE WITH SELECTABLE BUOYANCY

(75) Inventors: Timothy Lee Curtis, Fishing Creek, MD (US); Joseph Hewes Parrish, III, Raleigh, NC (US); Cleighton Lee Hilbert, Jr., Richmond, VA (US)

(73) Assignee: Swimways Corporation, Virginia Beach, VA (US)

( * ) Notice: Subject to any disclaimer, the term of this patent is extended or adjusted under 35 U.S.C. 154(b) by 540 days.

(21) Appl. No.: 11/683,264

(22) Filed: Mar. 7, 2007

(65) Prior Publication Data

US 2008/0057822 A1 Mar. 6, 2008

Related U.S. Application Data

(60) Provisional application No. 60/779,930, filed on Mar. 8, 2006.

(51) Int. Cl.
*A63H 23/00* (2006.01)

(52) U.S. Cl. ..... 446/153; 446/180; 273/440

(58) Field of Classification Search ..... 446/153–156, 446/158, 161, 176, 180, 186, 220, 159; 114/312; 273/440, 445; 434/254; 472/128
See application file for complete search history.

(56) References Cited

U.S. PATENT DOCUMENTS 3,943,869 A * 3/1976 Frechette ..... 114/330
4,187,796 A * 2/1980 Ess ..... 114/312
4,314,423 A * 2/1982 Lipsitz et al. ..... 446/303
4,826,465 A * 5/1989 Fleischmann ..... 446/162
5,221,161 A 6/1993 Toy
5,445,375 A 8/1995 Sweeny
5,621,390 A * 4/1997 Neal ..... 340/584
5,785,563 A 7/1998 Peaslee
5,865,663 A * 2/1999 Liao ..... 446/155
5,995,455 A * 11/1999 Kutosky ..... 368/73
6,142,092 A * 11/2000 Coupland ..... 114/331
6,443,799 B1 9/2002 Gibson
6,921,315 B2 * 7/2005 Kownacki ..... 446/162
7,234,703 B1 * 6/2007 Kusz ..... 273/445
2004/0092181 A1 5/2004 Porat

OTHER PUBLICATIONS

International Search Report and Written Opinion for Application No. PCT/US07/63586, mailed on Dec. 7, 2007, 8 pages.
Advertisement, fundexgames.com, undated.

* cited by examiner

*Primary Examiner*—Gene Kim
*Assistant Examiner*—Scott Young
(74) *Attorney, Agent, or Firm*—Cooley LLP

(57) ABSTRACT

A submersible device according to an embodiment of the invention includes a container configured to be selectively buoyant in a liquid. The container can have at least one of a variety of different buoyancy systems. For example, the container can include a reservoir where the volume can be adjusted. In another example, the container can include a reservoir in communication with a pump configured to control the intaking and expelling of a liquid. In another embodiment, the container also defines a first partitioned section and a second partitioned section. The first partitioned section is substantially liquid resistant and the second partitioned section defines a hole in communication with an exterior of the container. An actuator is configured to receive an input from a user and is configured to modify an interior volume of the second partitioned section based on the input.

15 Claims, 17 Drawing Sheets

SUBMERSIBLE DEVICE WITH SELECTABLE BUOYANCY

CROSS-REFERENCE TO RELATED APPLICATIONS

This application claims priority to Provisional Application No. 60/779,930, filed Mar. 8, 2006, the entire disclosure of which is hereby incorporated by reference.

BACKGROUND

This invention relates to a submersible device, and more particularly to an aquatic toy having a selectable buoyancy.

Numerous children's activity devices are useful to entertain and stimulate children playing in water. For example, some toy devices can be thrown into water, such as, for example, a pool. These devices can be of limited use since they either sink to the bottom of the pool or float on the surface of the water.

Thus, a need exists for a device that can be neutrally buoyant at varying depths of a pool.

SUMMARY OF THE INVENTION

A submersible device according to an embodiment of the invention includes a container configured to be selectively buoyant in a liquid. The container can have at least one of a variety of different buoyancy systems. For example, in one embodiment the container includes a reservoir where the volume can be adjusted. In another embodiment, the container includes a reservoir in communication with a pump configured to control the intaking and expelling of a liquid.

In another embodiment, the container defines a first partitioned section and a second partitioned section. The first partitioned section is substantially liquid resistant and the second partitioned section defines a hole in communication with an exterior of the container. An actuator is configured to receive an input from a user and is configured to modify an interior volume of the second partitioned section based on the input.

DETAILED DESCRIPTION

The submersible device described herein can be placed into a liquid, such as, for example a pool of water. For example, the apparatus can be configured as an aquatic activity device or toy that becomes neutrally buoyant at a designated depth and emits audible sounds. The device described herein can be used in multiple aquatic games. For example, a user can set a depth for the device to become neutrally buoyant and throw it into the pool. In some embodiments, another user may then search for the device by listening and following the audible signal.

Figure 1:
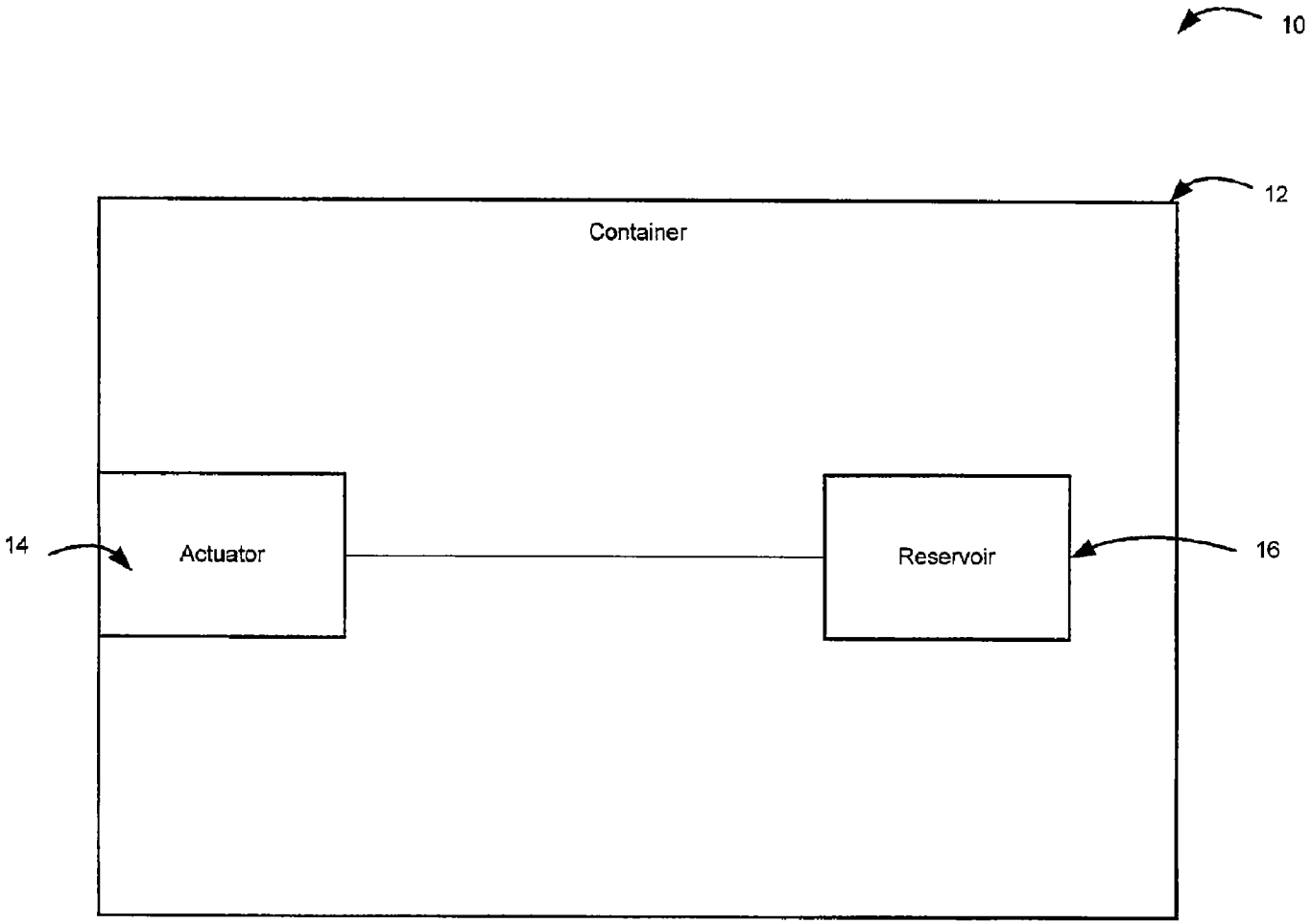
FIGS. 1-3 are schematic illustrations of a submersible device according to different embodiments of the invention.

FIG. 1 is a schematic illustration of an apparatus according to an embodiment of the invention. An apparatus 10 (also referred to herein as a "submersible device") can be placed or otherwise submerged into a body of liquid, such as a pool of water. As shown in FIG. 1, the submersible device 10 includes a container 12, an actuator 14 and a reservoir 16. The actuator 14 is disposed within the container 12 and modifies the volume of the reservoir 16 based on a user's input. The range of the different volumes of the reservoir 16 correspond to different specific depths of neutral buoyancy.

Figure 2:
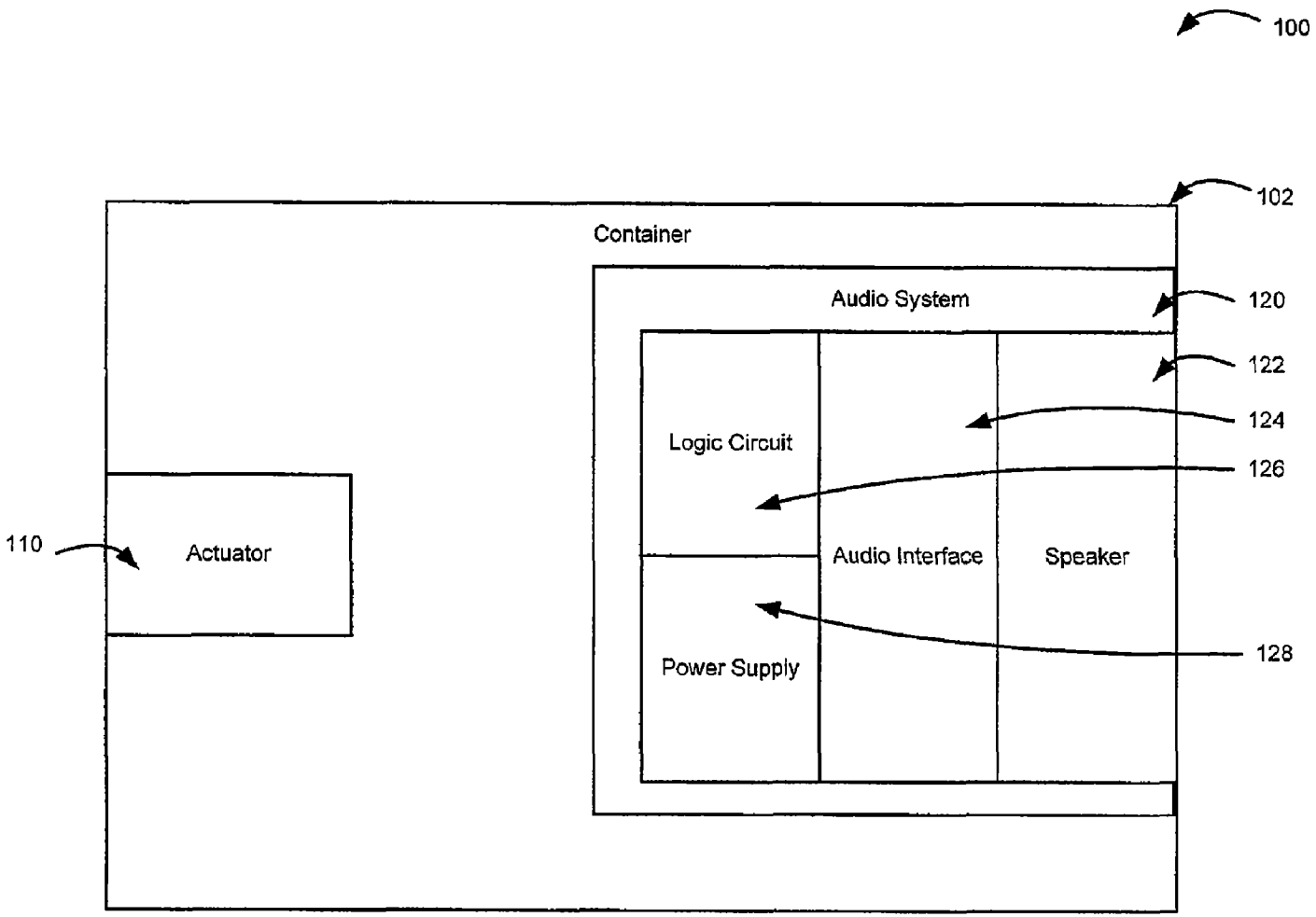

FIG. 2 is a schematic illustration of a submersible device according to an embodiment of the invention. A submersible device 100 includes a container 102, an actuator 110, and an audio system 120. The container 102 is configured to be selectively buoyant in a liquid. The actuator 110 and the audio system 120 are disposed within the container 102. A user selects the depth for neutral buoyancy using the actuator 110. The actuator 110 modifies an interior structure of the container 102 allowing the container 110 to become neutrally buoyant at a specified depth. The audio system 120 is coupled to the container 102 and is configured to selectively produce an audible output for a user-specified time period. The audio system includes a speaker 122, an audio interface 124, a logic circuit 126, and a power supply 128. The speaker 122 of the audio system 120 is in audio communication with the exterior of the container 102. The speaker 122 is coupled to the audio interface 124, which is coupled to the logic circuit 126 and power supply 128.

For example, a user can set the depth for the submersible device 100 to become buoyant in a pool via the actuator 110. The submersible device 100 can then begin to emit audible signals. After the submersible device 100 enters the water, it will submerge and maintain the user-selected depth. Another user can then search for the submersible device under the water only relying on his/her hearing.

Figure 3:
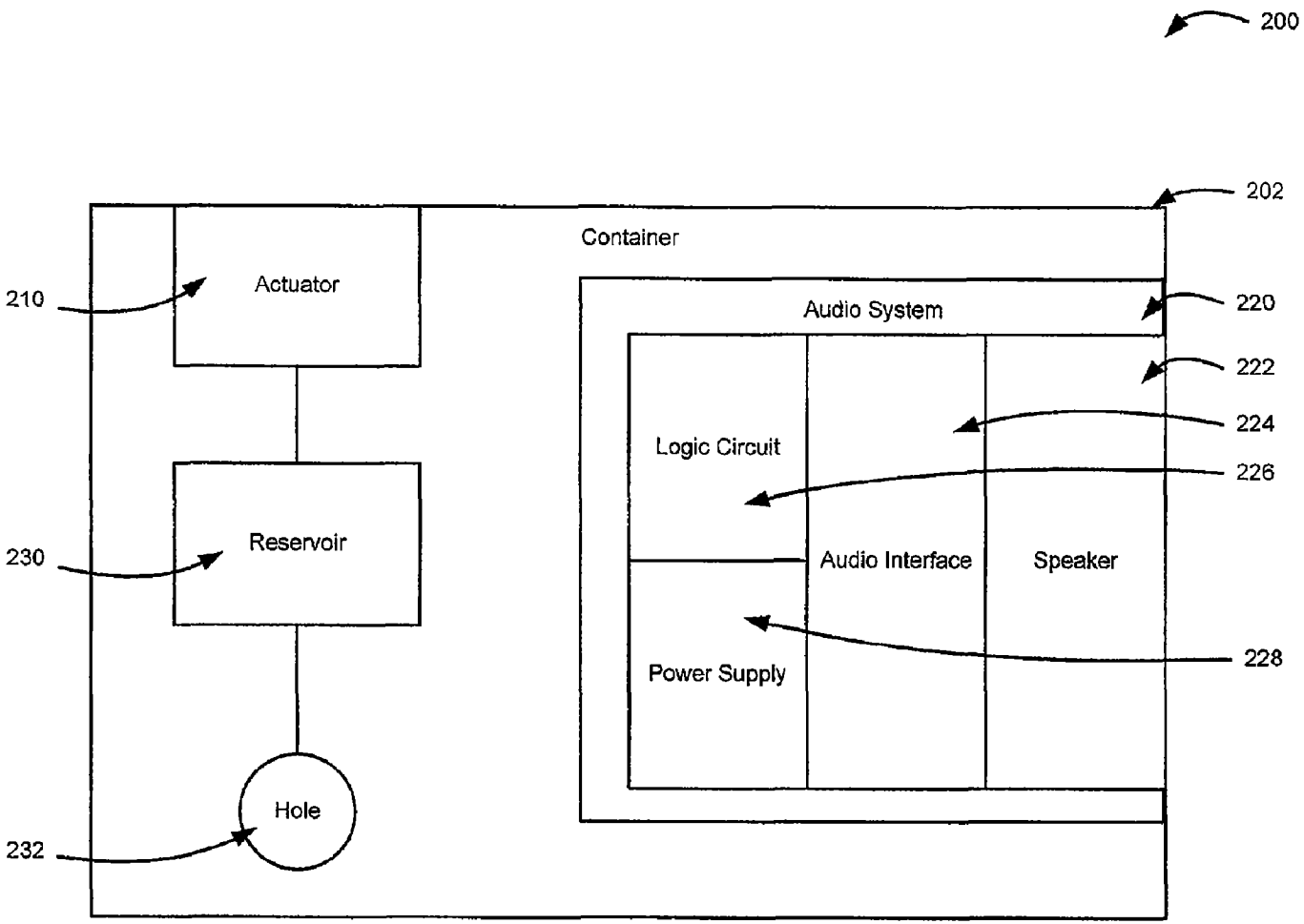

FIG. 3 is a schematic illustration of an apparatus according to an embodiment of the invention. A submersible device 200 has a container 202 that is configured to be selectively buoyant in a liquid. The container 202 includes an actuator 210 and an audio system 220, which includes a speaker 222, an audio interface 224, a logic circuit 226, and a power supply 228. In this embodiment, the container defines a hole 232 and a reservoir 230 in communication with the hole 232 to intake and store liquid. The actuator 210 adjusts the volume of the reservoir 230 within the submersible device 200 enabling the device to have an adjustable mass and therefore adjustable buoyancy. Once a depth is selected via the actuator 210 and the submersible device 200 is placed in a liquid, liquid enters and fills the reservoir 230 via the hole 232. The submersible device 200 now has a specific mass associated with a specific buoyancy allowing the submersible device 200 to become neutrally buoyant at the selected depth.

Figure 4:
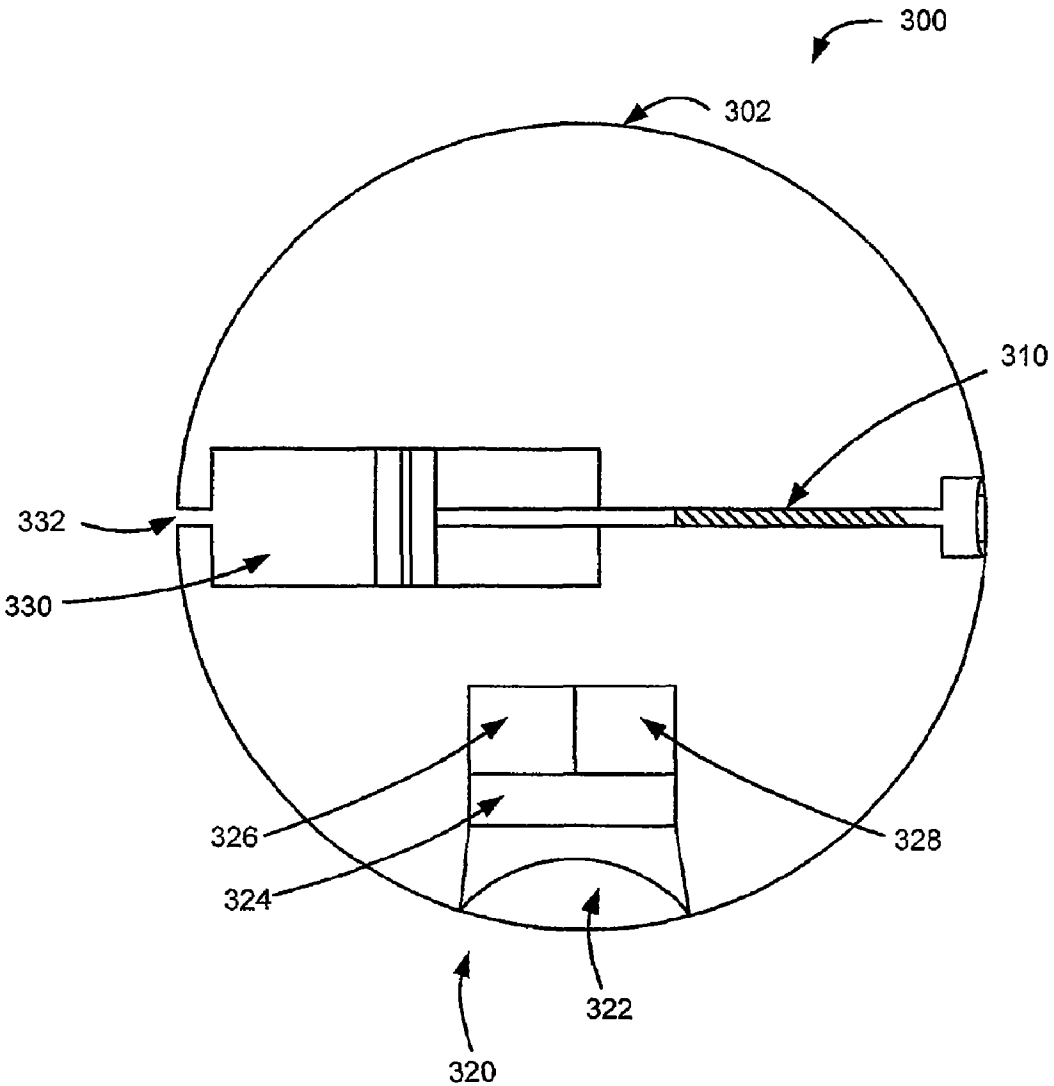
FIG. 4 is a cross-sectional view of a submersible device according to an embodiment of the invention.

FIG. 4 is a cross-sectional view of an apparatus according to an embodiment of the invention. As described in the above embodiment, a submersible device 300 has a container 302 that is configured to be selectively buoyant in a liquid. The container 302 includes an actuator 310, a reservoir 330, a hole 332, and an audio system 320 including a speaker 322, an audio interface 324, a logic circuit 326, and a power supply 328. In this embodiment, the container 302 is substantially spherical in shape. This embodiment is described in further detail with reference to FIGS. 5-13.

Figure 5:
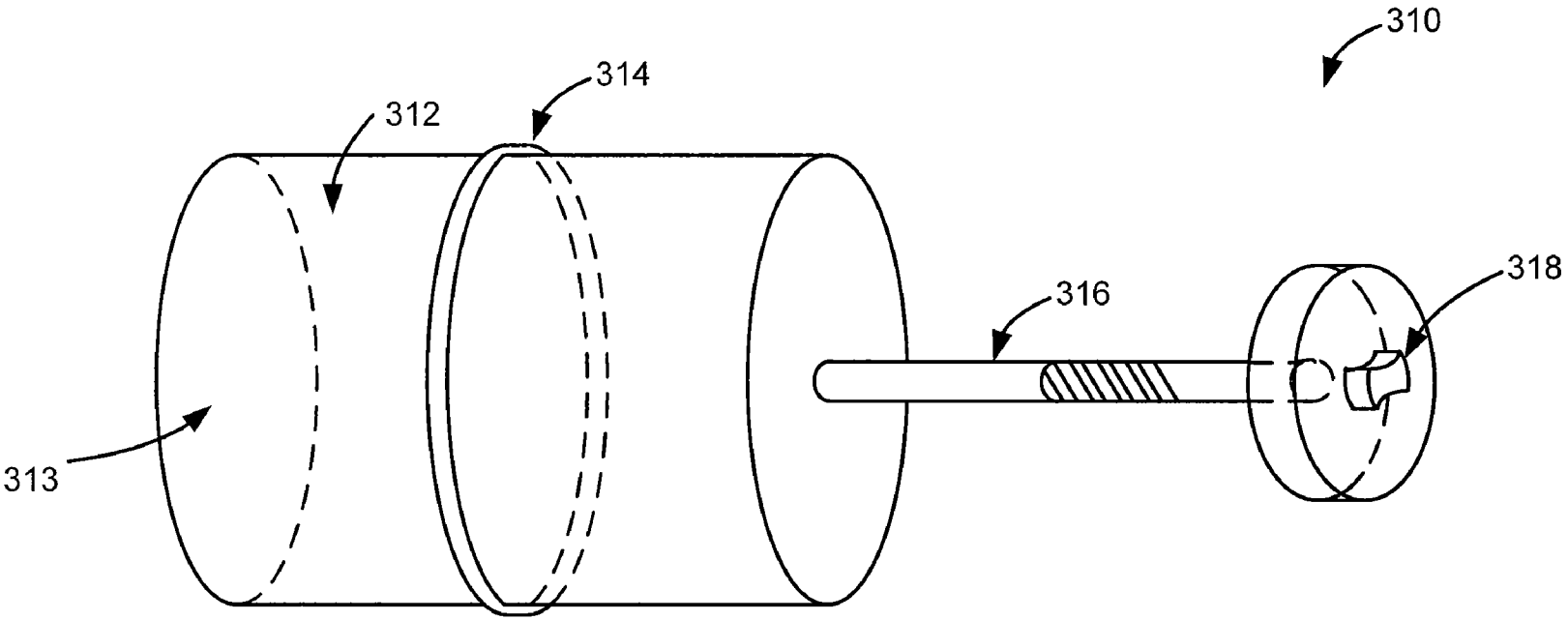
FIG. 5 is a side perspective view of a portion of a submersible device as shown in FIG. 4.

FIG. 5 is a side perspective view of the actuator portion shown in FIG. 4. The actuator 310 includes a piston 312, a piston head 313, an o-ring 314, a shaft 316, and a handle 318. The piston 312 is slidably disposed within the reservoir to adjust the volume of the reservoir. An o-ring 314 is configured to keep the liquid distal from the o-ring. The shaft 316 extends from the piston 312 to the handle 318. An axial rotation of the handle enables the shaft 316 to move the piston 312. In some embodiments, the shaft 316 may telescope to move the piston 312. In an alternative embodiment, the handle may be directly coupled to the piston with no shaft therebetween.

Figure 6:
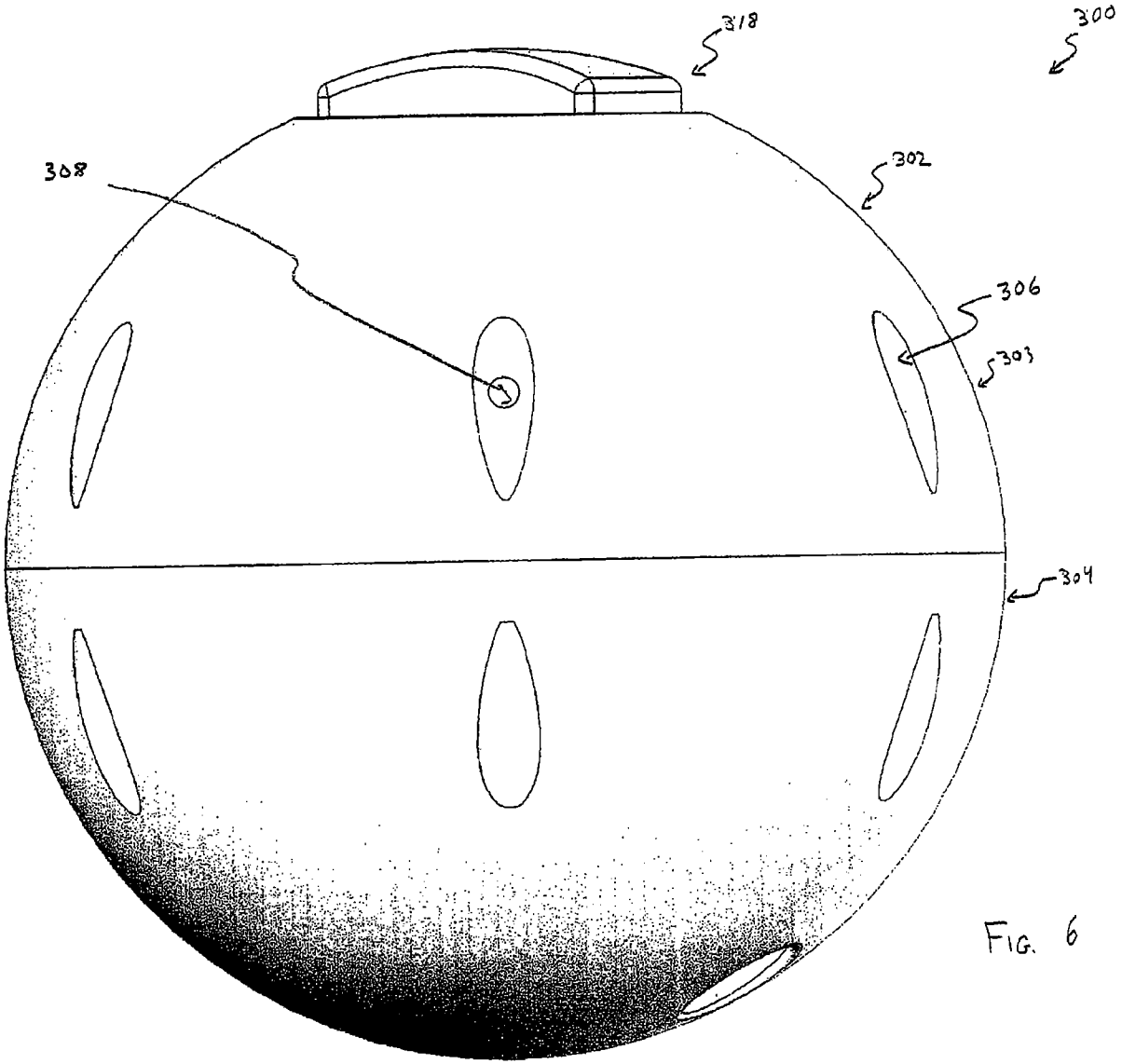
FIGS. 6-9 are side perspective views of outer portions of a submersible device shown in FIGS. 4 and 5.

FIGS. 6-9 are side perspective views of outer portions of an apparatus shown in FIGS. 4 and 5. The container 302 of the submersible device 300 can have a variety of different shapes. In this embodiment, the container 302 of the submersible device 300 is substantially spherical in shape, however, it should be understood that the container 302 can be any of a variety of different shapes and configurations, including for example, cubic, pyramidal, etc. As shown in FIG. 6, the handle 318 of the actuator is shown substantially flush with the exterior of the container 302 and does not detract from the overall shape of the container 302. The exterior of the container 302 has a first hemispherical portion 303 and a second hemispherical portion 304 affixed thereto. The container 302 defines multiple apertures 306 and has multiple screws 308 each of which is disposed the aperture 306. The screws 308 can maintain the position of the components within the container 302. The apertures 306 protect the user from inadvertently contacting the screws 308.

Figure 7:
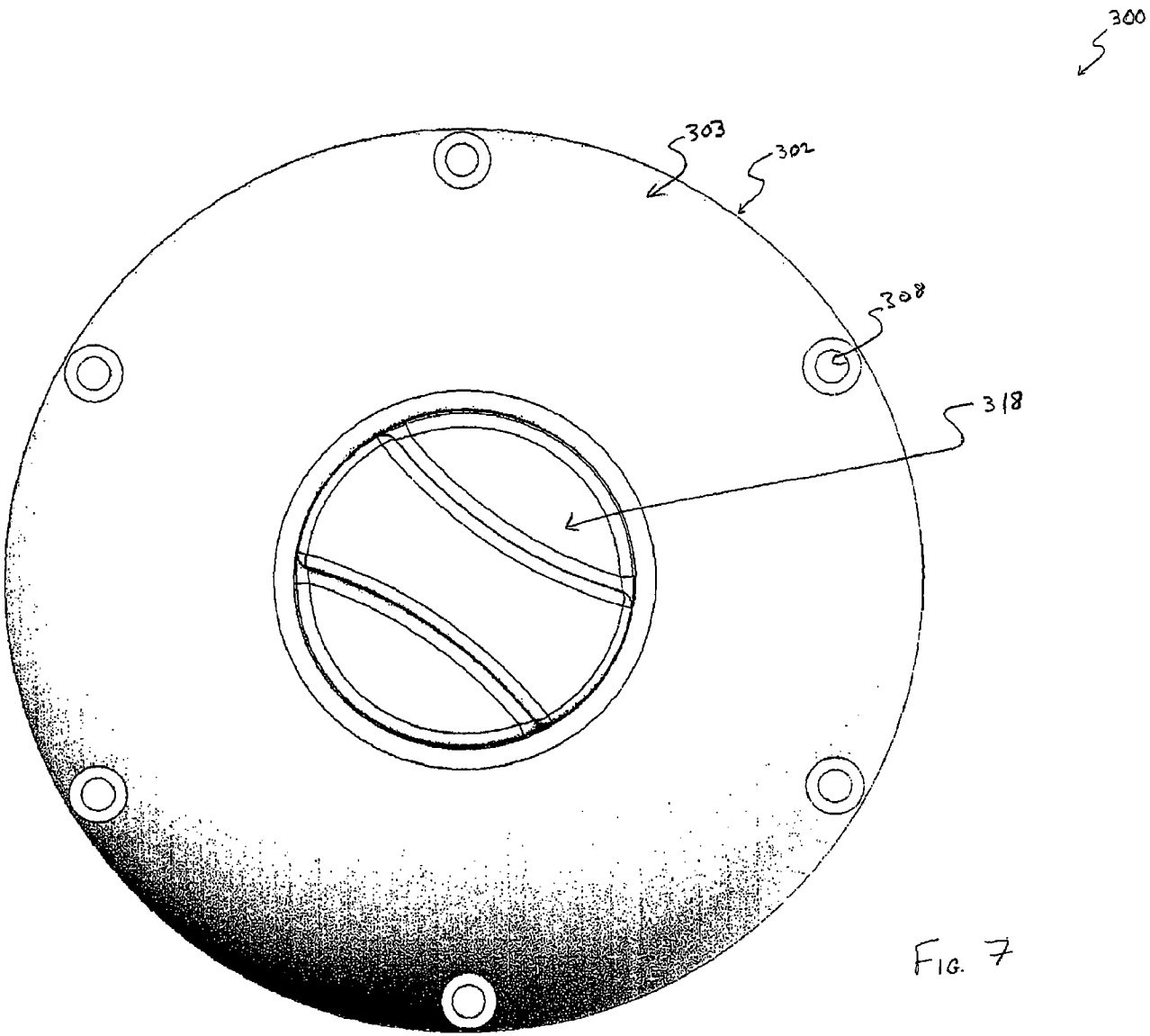

As shown in FIG. 7, the screws 308 couple the first hemispherical portion 303 to the second hemispherical portion. In an alternate embodiment, the first hemispherical portion and the second hemispherical portion can be coupled via a clamp, latch, etc.

Figure 8:
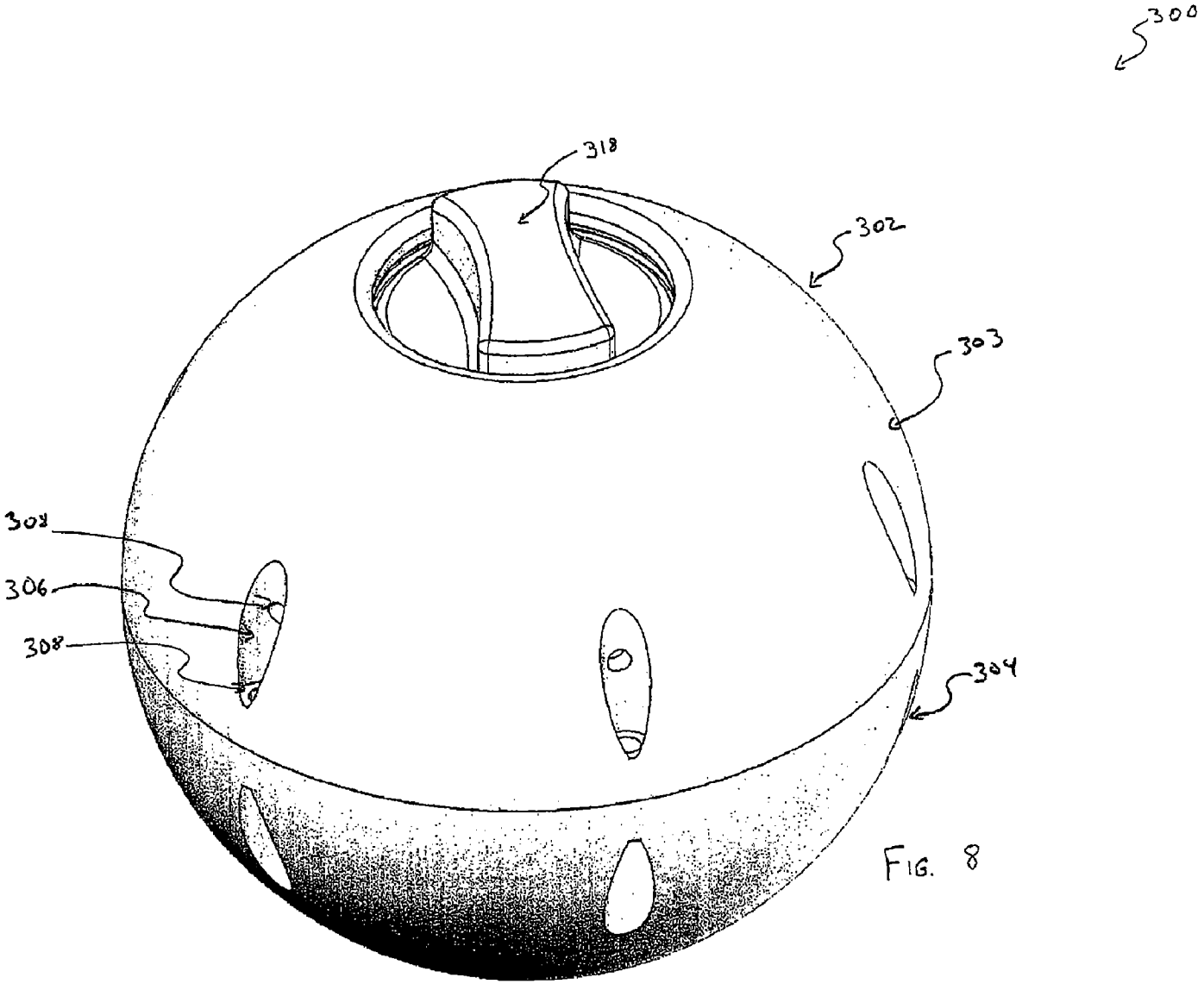

FIG. 8 is yet another side perspective view of the outer portion of the container 302 shown in FIGS. 6 and 7. The exterior of the container 302 is substantially soft and resilient to fracture. The soft exterior helps prevent the user from injury when in contact with the submersible device 300. The soft exterior also helps prevent the container 302 from fracturing in case the submersible device hits a hard surface, such as, for example, a ridge of a pool. The exterior can be composed of, for example, a plastic such as polypropelyne with an outer layer of soft foam affixed thereto.

In another embodiment, the outer portion of the container 302 is configured to be camouflaged with its surrounding liquid. The outer portion of the container 302 can be, for example, formed to have a color to substantially match the color of the surrounding liquid. For example, the container 302 can be formed of the color blue to camouflage the container 302 while submerged in a pool of water. Alternatively, the container 302 and as many of its internal components as possible can be, for example, substantially translucent making the submersible device 300 less visible. Alternatively, a combination of colored and translucent material can be used. For example, the container 302 and its internal components can be composed of a substantially translucent blue material to camouflage the device 300 in a pool of water.

Figure 9:
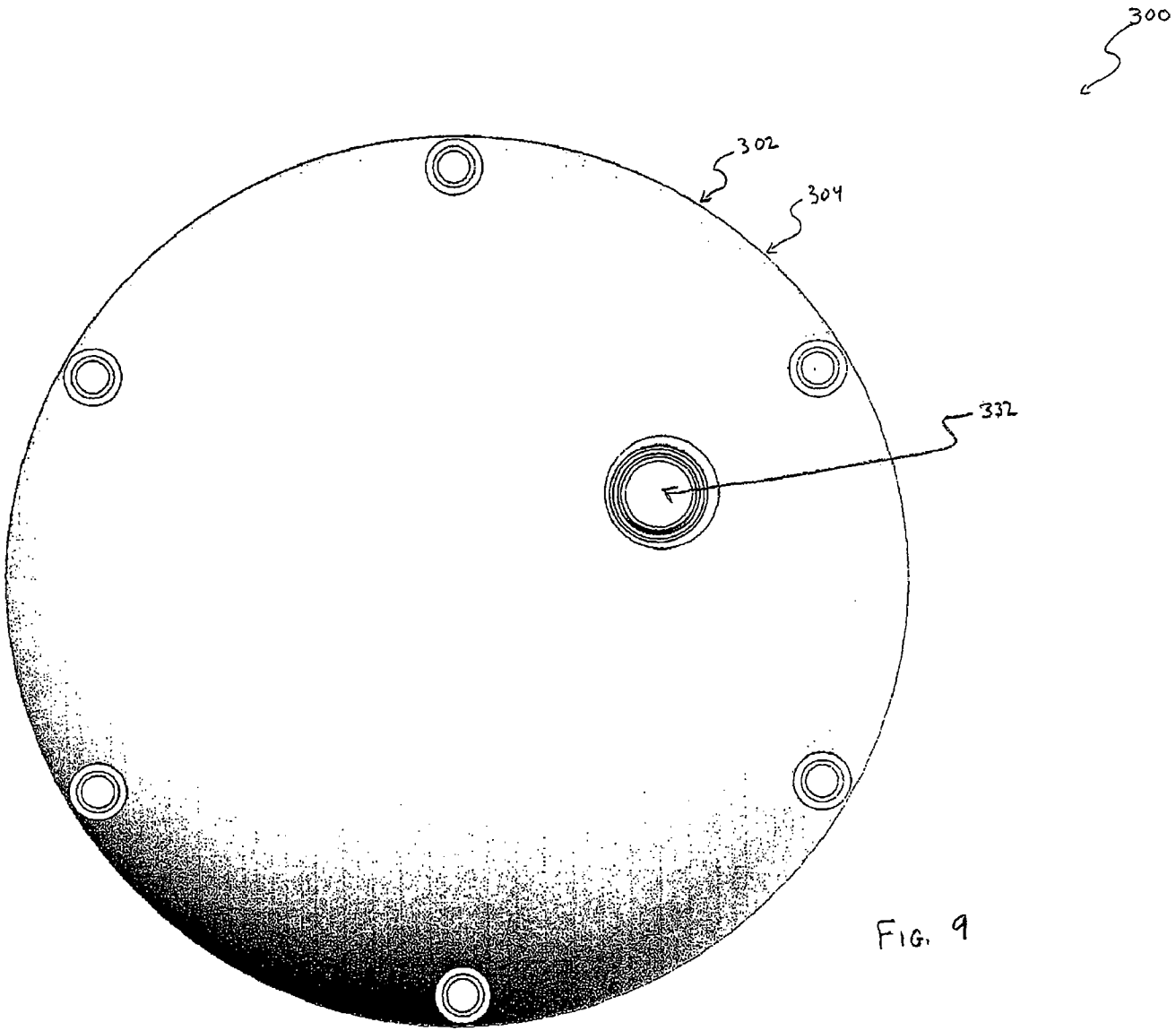

As shown in FIG. 9, the second hemispherical portion 304 defines a hole 332 in communication with the reservoir 330 disposed within the container 302.

Figure 10:
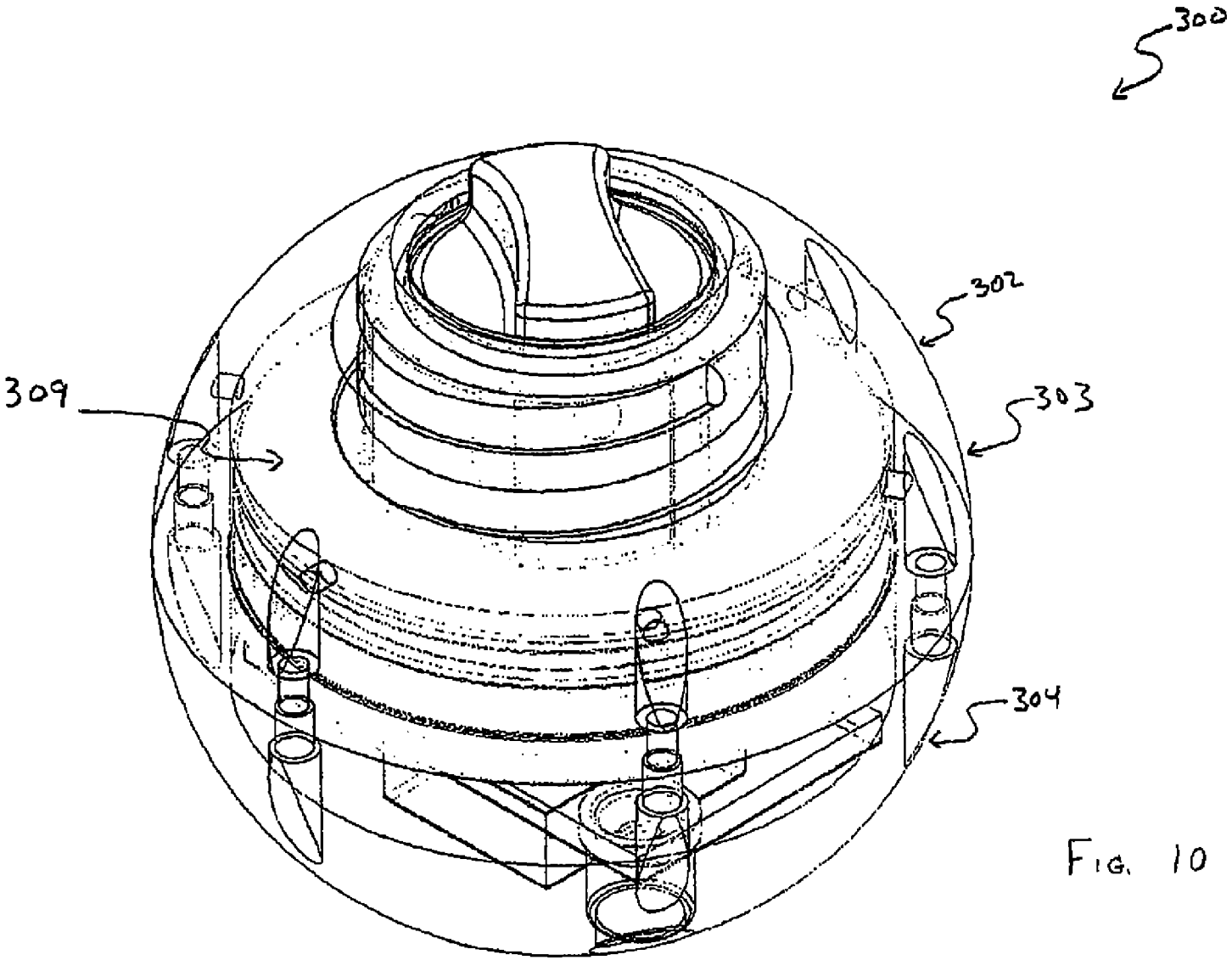
FIGS. 10-13 are side perspective views of an interior portion of a submersible device shown in FIGS. 4-9.
Figure 11:
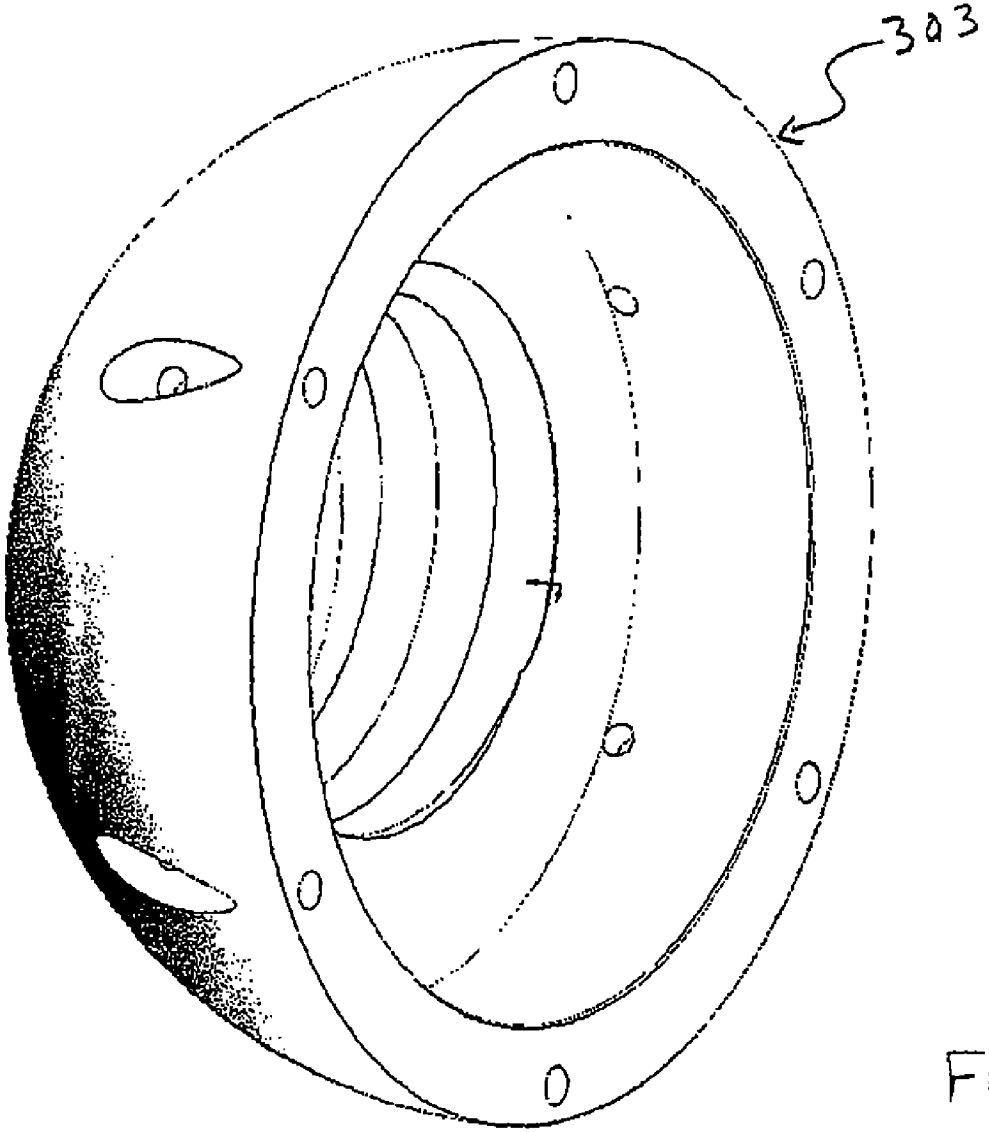
Figure 12:
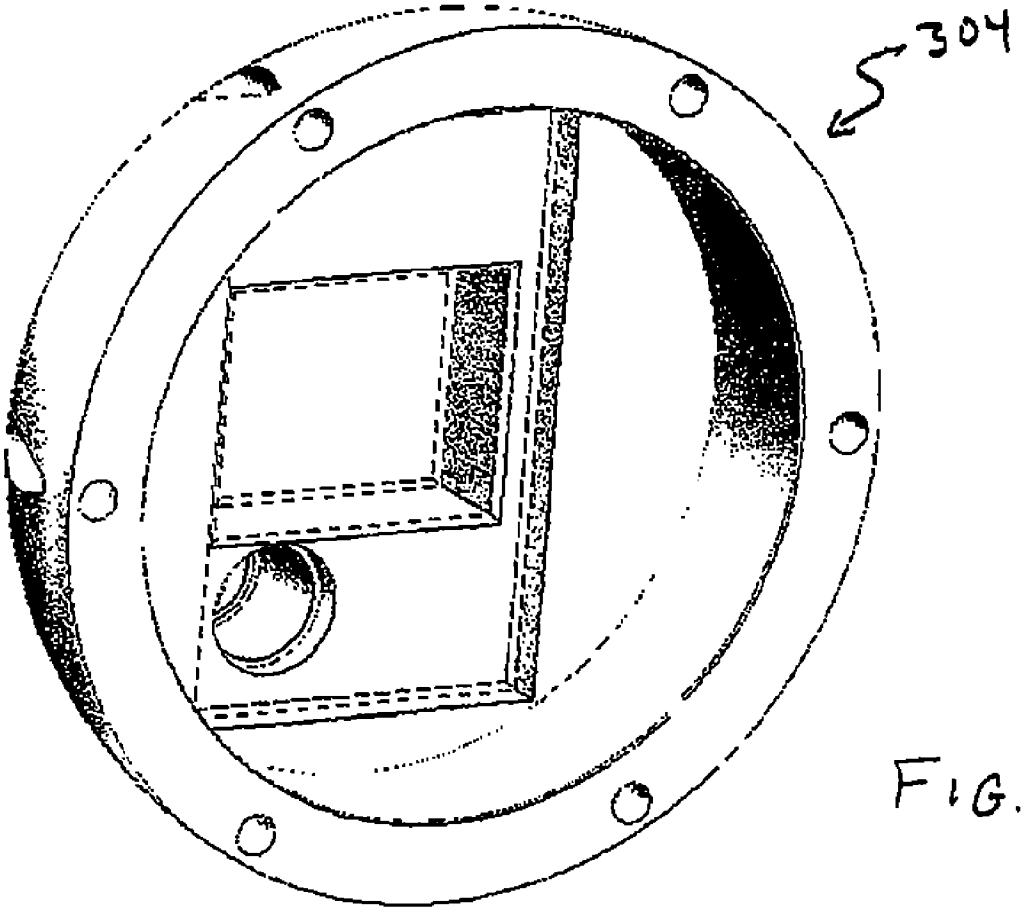
Figure 13:
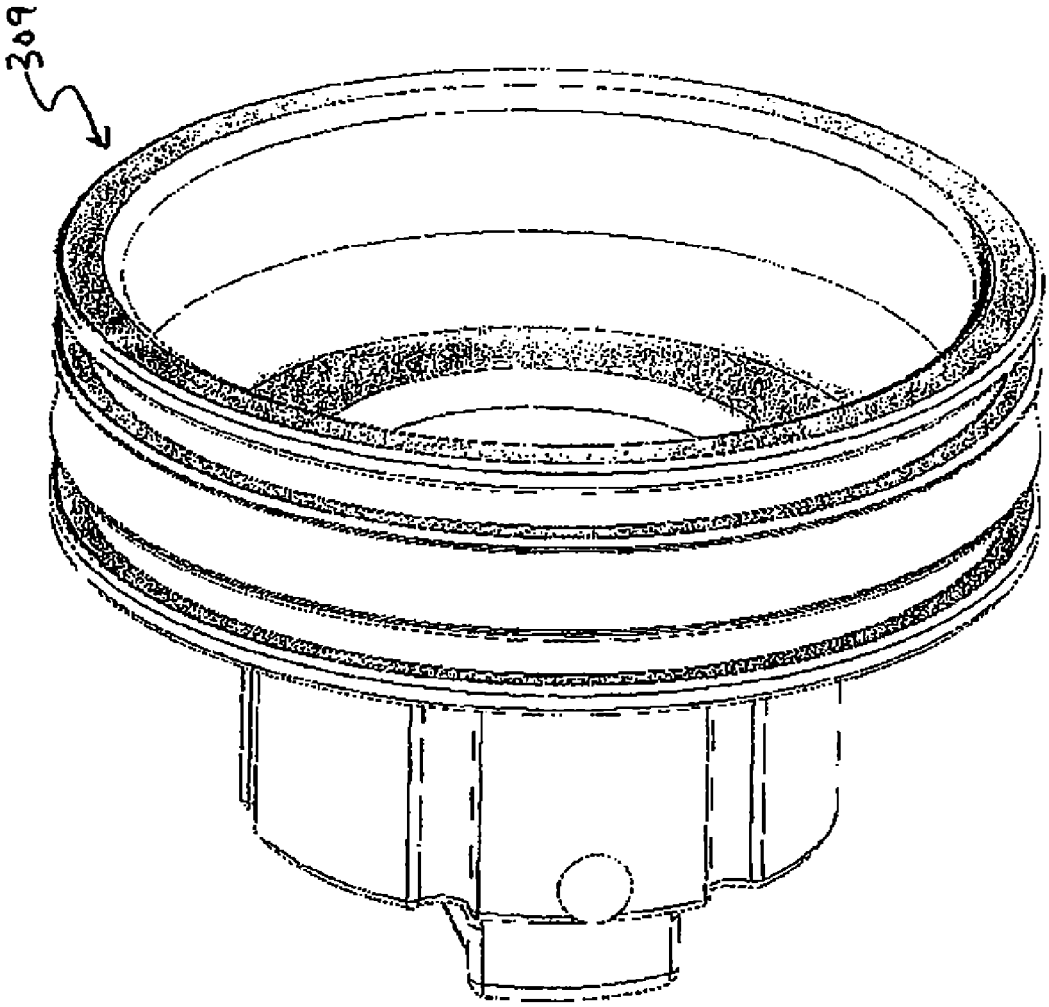

FIG. 10 illustrates an assembly-like side perspective view showing internal components according to this embodiment of the invention. More specifically, it shows the container 302 having a first hemispherical portion 303, a second hemispherical portion 304, and an actuator and reservoir housing 309. The first hemispherical portion 303, the second hemispherical portion 304, and the actuator/reservoir housing 309 of the container 302 are shown in FIGS. 11-13 respectively.

Figure 14:
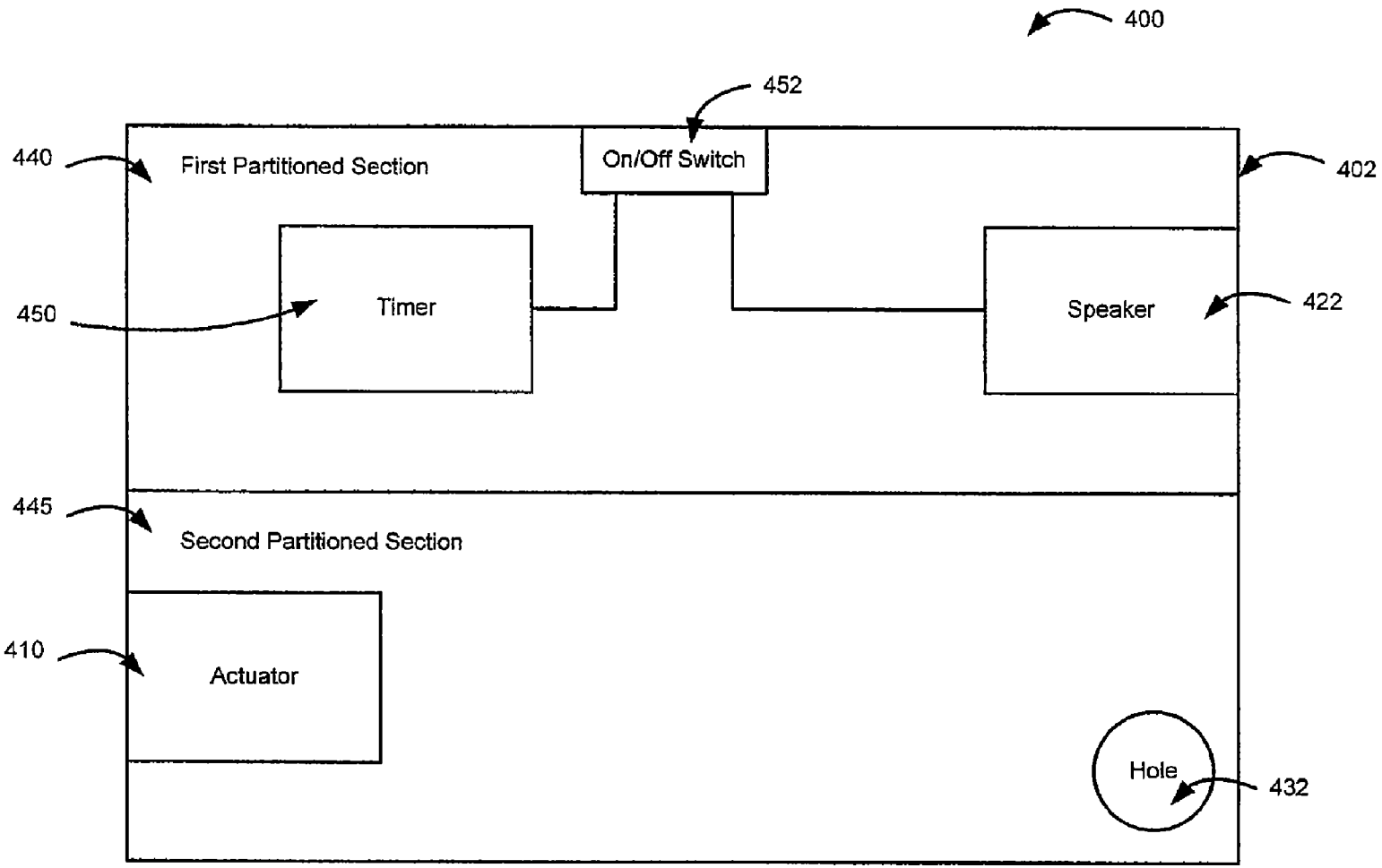
FIG. 14 is a schematic illustration of a submersible device according to an embodiment of the invention.

FIG. 14 is a schematic illustration of an apparatus according to an embodiment of the invention. A submersible device 400 includes a container 402 configured to be selectively buoyant in a liquid. The container 402 defines a first partitioned section 440 and a second partitioned section 445. The first partitioned section 440 is configured to be substantially liquid resistant while the second partitioned section 445 defines a hole 432 in communication with an exterior of the container 402. A timer 450 and a speaker 422 are disposed within the first partitioned section 440. An on/off switch 452 is configured to activate/deactivate a timer 450 and/or an audio signal upon user input and is disposed in the first partitioned section 440. An actuator 410 is configured to receive an input from a user and is configured to modify an interior volume of the second partitioned section 445 based on the input.

In some embodiments, the second partitioned section can include a reservoir in communication with the hole and can be configured to have an adjustable volume. In some other embodiments, the submersible device can include a sensor and a pump. The sensor can be coupled to the pump and can be disposed within the second partitioned section. The pump can be configured to expel water from or take water into, the reservoir based on a signal from the sensor. In other embodiments, the audio system of the submersible device may be actuated upon entering the water via a signal from the sensor.

Figure 15:
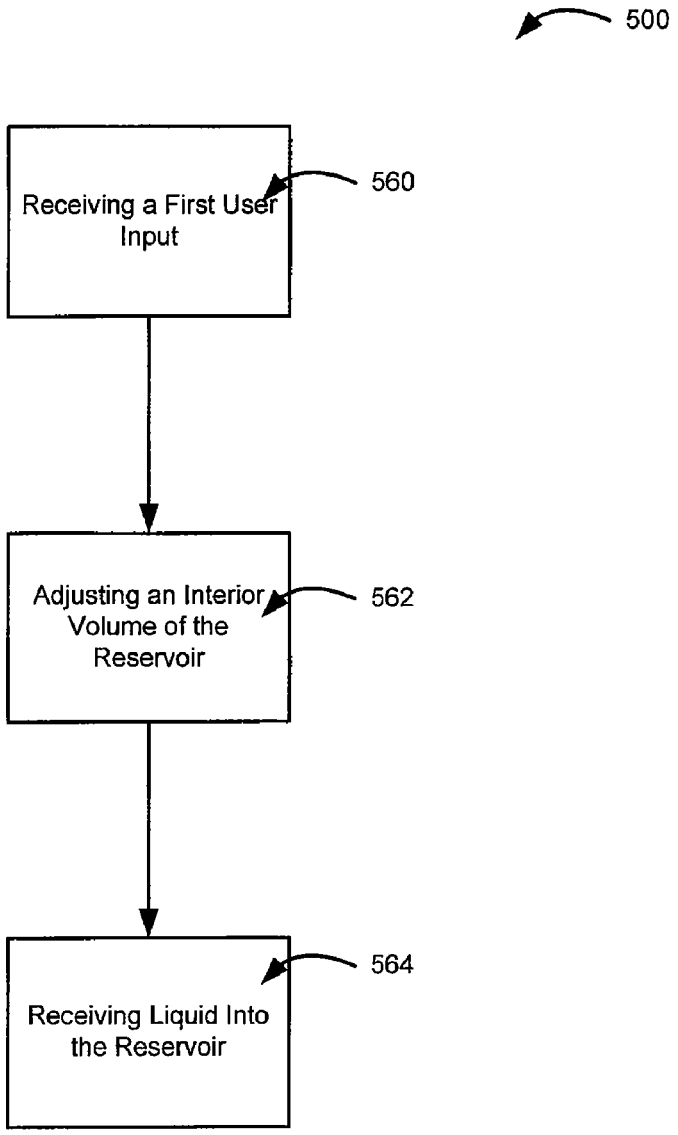
FIG. 15 is a flow chart illustrating a method according to an embodiment of the invention.

FIG. 15 is a flow chart illustrating a method according to an embodiment of the invention. At 560, a first user input is received to designate a depth for a device to become neutrally buoyant. At 562, an interior volume of the reservoir is adjusted. At 564, a liquid is received into the reservoir of the device such that the device becomes neutrally buoyant at the depth.

In some embodiments, audible signals are emitted from the device for a time period. The emitting of audible signals is discontinued if a second user input is received in the time period.

In some embodiments, the method can include sensing an amount of liquid received within the device and sending a control signal to a pump when the amount of liquid received in the device reaches a predefined amount for neutrally buoyancy at the depth. For example, a sensor disposed within the reservoir can measure the amount of liquid in the reservoir. Once an amount of liquid correlating to the buoyancy desired is reached, the sensor can send a signal to the pump to stop the submersible device from receiving any more liquid.

In some embodiments, the method can include propelling the submersible device in the liquid. Propelling the submersible device via a propulsion system can increase the level of effort and difficulty for the user to find and deactivate the device. The propelling of the device can be, for example, constant or for randomly selected time intervals. In such embodiments, the submersible device can include a propulsion system that can be coupled to the container and configured to propel the container. At least a portion of the propulsion system can be in communication with the exterior of the container. Propulsion systems can include, for example, propeller systems, water jet systems, paddle wheel systems, etc.

Similarly, in some embodiments, the depth of a device can be varied during the time period. For example, after a first user-selected depth is reached the depth of neutral buoyancy can change by, for example, varying the volume of the reservoir. The submersible device can rise from a deeper depth to a shallower one and/or vice versa. Such changes in the depth of neutral buoyancy can occur for fixed or varied time intervals within the overall time period.

In some embodiments, a frequency of the audible signals can be varied during the time period. For example, the frequency can be selected to be associated with the depth of neutral buoyancy of the device. Similarly, in some embodiments, a volume of the audible signals can be varied during the time period. For example, the volume can be selected to be associated with the depth of neutral buoyancy of the device. Alternatively, the volume can increase as the time period nears expiration. Alternatively, the frequency of the audible signal and/or the volume of the audible signal can be user-selected. For example, a user can select a frequency to distinguish their submersible device from other submersible devices in the same body of liquid, for example, a community pool.

In some embodiments, a visual indicator can be displayed to the user. The visual indicator can show, for example, the amount of time left to deactivate the device, internal component information, user instructions, etc. The amount of time left for a user to deactivate the device can be indicated by, for example, a countdown timer, a flashing light, and the like. For example, the frequency of the flashing light can increase as time for the user to find and deactivate the device decreases.

In some embodiments, a series of consecutive time periods can be established by the device. In other words, after a first user finds and deactivates the device, the submersible device can signal a second user to find and deactivate the device. The time period for the first user ends and the time period for the second user begins upon the first user deactivating the device.

Figure 16:
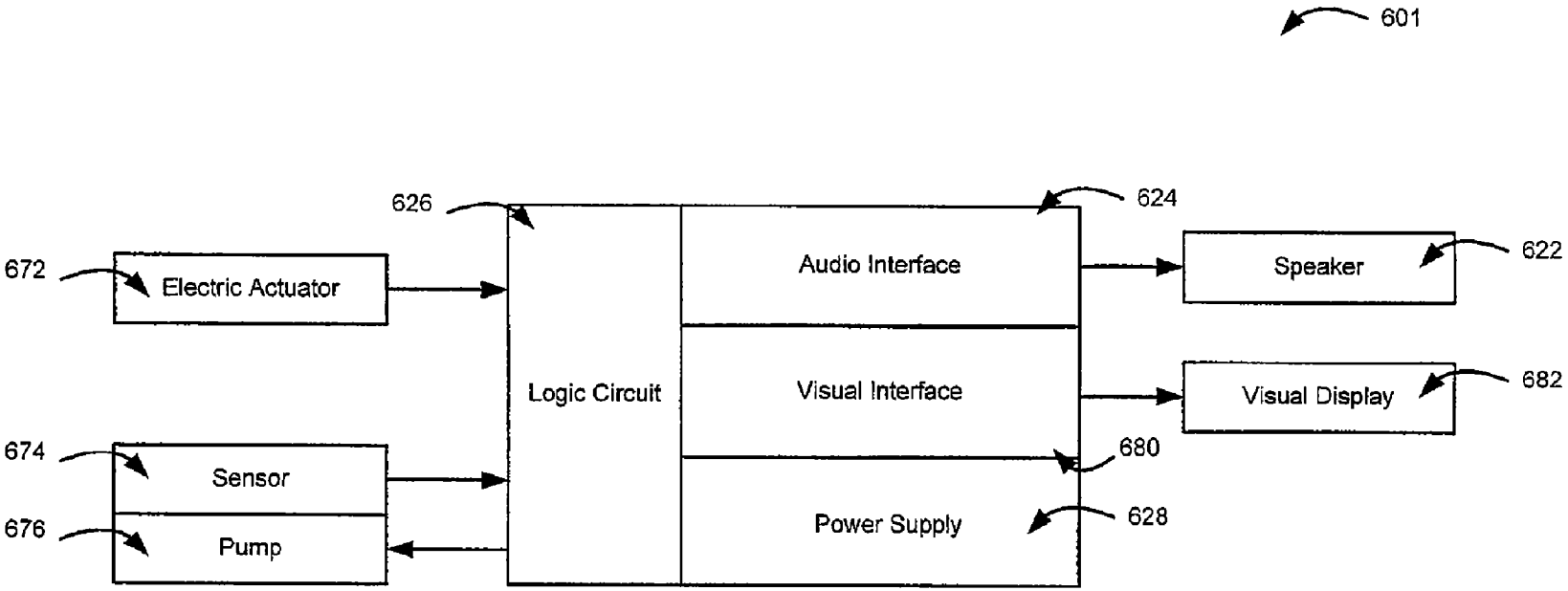
FIG. 16 is a schematic illustration of a submersible device, according to yet another embodiment of the invention.

FIG. 16 is a schematic illustration of a submersible device, according to yet another embodiment of the invention. As shown in FIG. 16, the overall system 601 includes an electronic actuator 672, a sensor 674, a pump 676, a logic circuit 626, an audio interface 624, a speaker 622, a visual interface 680, a visual display 682, and a power supply 628. The logic circuit 626 is coupled to and receives input signals from the electronic actuator 672 and the sensor 674. The logic circuit 626 is coupled and sends signals to the audio interface 624, the visual interface 680, and the pump system 676. The audio interface 624 is coupled and sends signals to the speaker 622. Similarly, the visual interface 682 is coupled and sends signals to the visual display 682. The power supply 628 supplies power to each of the different components.

The sensor 674 is coupled to the pump 676 and is configured to expel or intake liquid based on a signal from the sensor 674 to control the buoyancy of the submersible device. Pumps can include, for example, a positive displacement pump, a centrifugal pump, and the like. In other embodiments, the pump 676 either intakes or expels liquid from the reservoir based on a feedback signal from the sensor 674 to counteract deviations from the selected depth of neutral buoyancy.

The visual display 682 can be configured to selectively produce a visual output with at least a portion of the visual output being visible from an outside container. In other words, the visual interface 680 is coupled and sends signals to the visual display 682 to communicate information to the user. In some embodiments, the visual display 682 can be visible after a user-specified time period. For example, a user may not be able to locate the submersible device even with loud audible signals and a visual display of a countdown timer. Therefore, the submersible device can display a visual beacon after a period to time enabling the user to find the device. The beacon can be, for example, a high-intensity flashing light, a colored light, and the like. Similarly, an audible beacon can be used alone or in combination with the visual display to assist the user in locating the device after the time period has ended.

In another alternative embodiment, the submersible device can include a timer that is coupled to the audio system and can be configured to activate and/or deactivate the audio system based on the timer. In an another alternative embodiment, the submersible device can include a memory storage device coupled to the container and configured to store user-specified input including at least one of the selected buoyancy or the user-specified time period.

In yet another alternative embodiment, the submersible device can have an audio system with an audible output that has a frequency at a first time within the user-specified time period and a frequency at a second time within the user-specified time period different from the frequency at the first time. Similarly, in some embodiments, the submersible device can have an audio system with an audible output that has a volume at a first time within the user-specified time period and a volume at a second time within the user-specified time period different from the volume at the first time.

Figure 17:
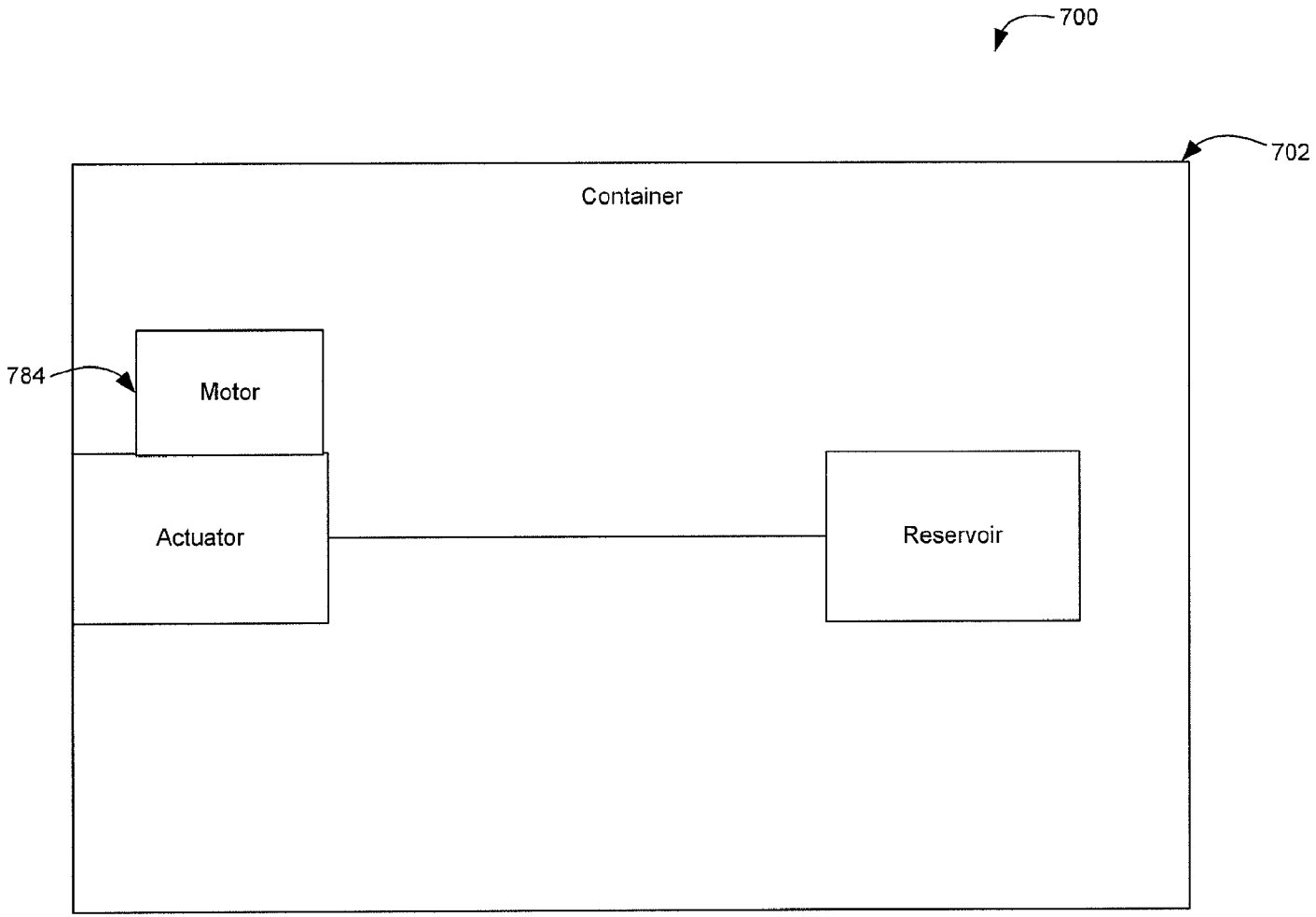
FIG. 17 is a schematic illustration of a submersible device, according to yet another embodiment of the invention.

In some embodiments, as seen in FIG. 17 a submersible device 700 can include a motor 784, which can be coupled to a container 702 and configured to change the selected buoyancy during the user-specified time period. For example, an electric motor can be coupled to the shaft of the actuator and configured to move the shaft and therefore the piston based in a user-specified input. Other motors can include, for example, pneumatic motor, hydraulic motor, thermodynamic motor, and the like. In other embodiments, the motor can change the volume of the reservoir to counteract deviations from the selected depth of neutral buoyancy. In an alterative embodiment, the actuator can, at least in part, include a magnetic button coupled to a hall effect sensor, which can used in place of a sealed switch.

In some embodiments, the actuator can have pre-set positions indicated by a tactile and/or audio response for a given position (e.g. a "click" for a position). The pre-set positions can be associated with specific depths of selected buoyancy. For example, one position can be associate with a depth of neutral buoyancy of 3 feet.

CONCLUSION

While various embodiments have been described above, it should be understood that they have been presented by way of example only, and not limitation. While specific embodiments have been particularly shown and described, it will be understood that various changes in form and details may be made.

For example, a submersible device can include various combinations and sub-combinations of the various embodiments described herein.

What is claimed is:

1. An apparatus, comprising:

a container defining a reservoir with a variable interior volume, the container being configured to be selectively buoyant in a liquid based on a size of the variable interior volume of the reservoir, the container defining a hole, the reservoir being in communication with the hole;

an actuator configured to receive a first user input from a user and configured to select the buoyancy;

a timer disposed within the container;

an audio system coupled to the timer and having a speaker in audio communication with the exterior of the container, the audio system configured to selectively produce an audible output for a user-specified time period with a volume that increases as the user-specified time period nears expiration, the audio system configured to discontinue the audible output when a second user input is received, the audible output having a user-selectable frequency;

a sensor disposed within the reservoir defined by the container, the sensor being configured to determine an amount of liquid received within the reservoir; and a pump coupled to the sensor, the pump configured to expel or intake liquid based on a signal from the sensor.

2. The apparatus of claim 1, wherein the actuator includes a handle configured to receive a buoyancy input from a user, the actuator configured to select a buoyancy based on the buoyancy input, the handle being disposed at a location of the container substantially opposite a location of the hole.

3. The apparatus of claim 1, further comprising a visual display coupled to the container and configured to selectively produce a visual output including a flashing light having a frequency that increases as time remaining in the user-specified time period near expiration, at least a portion of the visual display being visible from an outside of the container.

4. The apparatus of claim 1, further comprising a visual display coupled to the container and configured to selectively produce a visual output, at least a portion of the visual display being visible from an outside of the container after the user-specified time period.

5. The apparatus of claim 1, further comprising a propulsion system coupled to the container and configured to propel the container at random time intervals, at least a portion of the propulsion system being in communication with the exterior of the container.

6. The apparatus of claim 1, wherein the container is substantially spherical in shape, the container has an exterior portion and an interior portion, the exterior portion is substantially translucent and substantially soft, the interior portion is substantially blue in color.

7. The apparatus of claim 1, further comprising a motor, coupled to the container, the motor configured to change the selected buoyancy at varied time intervals during the user-specified time period.

8. The apparatus of claim 1, wherein the actuator includes a piston slidably disposed within the reservoir, a shaft coupled to the piston and a handle coupled to the piston, the handle configured to axially rotate such that the shaft moves the piston to vary the size of the selectable interior volume of the reservoir.

9. An apparatus, comprising:

a container configured to be variably buoyant in a liquid, the container defining a first partitioned section and a second partitioned section, the first partitioned section being substantially liquid resistant, the second partitioned section defining a hole in communication with an exterior of the container;

an actuator configured to receive an input from a user and configured to modify an interior volume of the second partitioned section based on the input;

an audio system disposed within the first partitioned section, the audio system including a speaker in audio communication with the exterior of the container, the audio system configured to produce an audible output for a user-selected time period and with a volume that increases as the user-selected time period nears expiration;

a timer disposed within the first partitioned section and coupled to the audio system;

wherein the second partitioned section defines a reservoir in communication with the hole;

a sensor disposed within the reservoir, the sensor configured to determine an amount of liquid received within the reservoir; and a pump, the sensor being coupled to the pump and being disposed within the second partitioned section, the pump configured to expel or intake liquid based on a signal from the sensor.

10. The apparatus of claim 9, wherein the second partitioned section is configured to have an adjustable interior volume.

11. The apparatus of claim 1, wherein the audio system is configured to produce the audible output when a user selects a depth for the container to become buoyant.

12. The apparatus of claim 1, wherein:

the user-specified time period is a first user-specified time period, the audible output is a first audible output, the audio system is configured to selectively produce a second audible output for a second user-specified time period, the second user-specified time period begins when the first user-time period expires or is discontinued by the second user input, the second audible output is discontinued when a third user input is received.

13. The apparatus of claim 1, wherein the audible output has a volume and a frequency, the volume is associated with a depth of the container, the frequency is associated with the depth of the container.

14. The apparatus of claim 9, wherein the audible output has a volume and a frequency, the volume is associated with a depth of the container, the frequency is associated with the depth of the container.

15. The apparatus of claim 9, wherein the audio system is configured to produce the audible output when a user selects a depth for the container to become buoyant.

* * * * *